United States Patent [19]

Porter

[11] 4,355,856

[45] Oct. 26, 1982

[54] LOW INSERTION FORCE CONNECTOR USING NON-NOBLE METAL CONTACT PLATING

[75] Inventor: Warren W. Porter, Escondido, Calif.

[73] Assignee: NCR Corporation, Dayton, Ohio

[21] Appl. No.: 194,491

[22] Filed: Oct. 6, 1980

[51] Int. Cl.[3] ..... H01R 13/38

[52] U.S. Cl. ..... 339/95 R; 339/75 MP

[58] Field of Search ..... 339/75 R, 75 M, 75 MP, 339/95 R, 95 D

[56] References Cited

U.S. PATENT DOCUMENTS

| | | | |
|---|---|---|---|
| 2,920,163 | 1/1960 | Johnson | 339/95 D |
| 4,118,094 | 10/1978 | Key | 339/75 MP |

FOREIGN PATENT DOCUMENTS

| | | | |
|---|---|---|---|
| 2423266 | 12/1974 | Fed. Rep. of Germany | 339/75 MP |
| 44-22981 | 9/1969 | Japan | 339/75 MP |
| 493946 | 11/1975 | U.S.S.R. | 339/75 MP |
| 639056 | 12/1978 | U.S.S.R. | 339/75 MP |

*Primary Examiner*—Joseph H. McGlynn

*Attorney, Agent, or Firm*—J. T. Cavender; Edward Dugas; Arthur A. Sapelli

[57] ABSTRACT

An electrical connector permits the use of non-noble metals by providing mechanical advantage in obtaining high contact force with low insertion force. A pin is utilized as a cantilever beam to provide high contact force. A carrier, which is activated by insertion by a printed circuit board or the like, includes a lever forming part of the electrical connection. The lever is displaced causing deflection of the pin. The lever has contact points capable of piercing non-metallic oxides, thereby forming good electrical contacts.

14 Claims, 12 Drawing Figures

LOW INSERTION FORCE CONNECTOR USING NON-NOBLE METAL CONTACT PLATING

BACKGROUND OF THE INVENTION

This invention relates to an electrical connector and more particularly to a low insertion force connector having a contact arrangement which provides a good electrical contact and permits the use of non-noble metals.

In many systems and for a variety of reasons, many electronic elements, components, circuitry, and interconnections are presently mounted, deposited, printed, or otherwise formed on one or both sides of a board (a printed circuit board, PCB) or other suitable substrate. Electrical interconnections of the PCB or the like and a backpanel or the like of the system is generally accomplished by a connector.

These connectors generally include a housing which is bolted or otherwise affixed to the backpanel, and the housing is formed with a longitudinal slot for receiving one edge of the printed circuit board or the like. The connector is provided with a plurality of individual interconnection elements each of which is adapted to suitably contact the backpanel on one end, and to suitably contact the printed circuit board or the like on the other end. The electrical connections provided by these interconnection elements are formed in various well known manners with the connections to the backpanel being relatively permanent in comparison to the connections made with the printed circuit board or the like.

In many connector configurations, the interconnection elements are formed so that one end of each interconnection element protrudes through the backpanel and wire-wrapped or otherwise connected. Connections between the interconnection element and the PCB or the like are generally made by mechanically biasing the interconnection elements of the connector into engagement with the edge contacts of the printed circuit board or the like. This mechanical biasing force serves two purposes, the first being to provide the electrical connections and the second being to grip the printed circuit board or the like, and thus hold the PCB or the like in the connector. It should be apparent that the biasing force exerted by the interconnecting elements must be relatively high to insure that good conductive contacts are made and maintained. The high biasing force causes a high insertion force of the PCB or the like which becomes excessive when the number of the interconnection elements of the connector is of a large quantity, the problem of the high insertion force being the impetus behind the development of zero insertion force and low insertion force connectors.

Another problem with these connectors is that the contact areas of the edge contacts and the interconnecting elements will rub against each other with considerable force during insertion and removal of the printed circuit board or the like. Since the edge contacts of a typical printed circuit board are only a few thousandths of an inch thick, this rubbing action which occurs during insertion and removal of the printed circuit board tends to wear away the edge contacts and may well ruin a PCB after several insertions and removals. This rubbing action may also wear away highcost precious metal on the surface of the interconnecting elements which invites poor electrical contacts or corrosion and can result in hard to detect failures of the equipment.

In view of these above stated problems several attempts have been made to produce what has become known in the art as a zero or low insertion force connector. Generally, these zero or low insertion force connectors are provided with mechanical actuating mechanisms which move the contact area of the interconnections elements out of the insertion and removal path of the printed circuit board or the like and allow the interconnecting elements to move into engagement with the edge contacts after the printed circuit board or the like has been inserted. Such a zero or low insertion force connector is disclosed in U.S. Pat. No. 4,189,199, entitled "Electrical Socket Connector Construction." This reference discloses an actuating mechanism which is activated by the insertion of an integrated circuit pack causing the interconnecting elements to move and make contact with the pins of the integrated circuit pack, resulting in a zero insertion force connector and eliminating any rubbing or wiping action between the pins of the integrated circuit pack and the interconnecting elements. Eliminating the rubbing or wiping action requires the interconnecting elements to be reasonably free from any contamination in order to form a good electrical contact. Gold or gold plated interconnecting elements and pins are presently being utilized in order to obtain contamination-free connections. With the cost of gold increasing substantially, the use of gold in connectors is becoming less desirable.

Therefore, a need exists for a new and improved zero or low insertion force connector which allows the use of a non-noble metal by providing a way of wiping off or piercing the non-noble metallic oxides, thus forming good electrical contacts.

SUMMARY OF THE INVENTION

In accordance with the present invention, a new low insertion force connector has been devised. The electrical connector, for connecting to an edge contact of a printed circuit board or the like, includes a pin made of an electrically conductive resilient material and a carrier, made of an electrically insulative material which is actuated by insertion of the printed circuit board or the like. A lever, made of an electrically conductive material and being partially encased within the carrier, has two ends which are pointed or edged. The carrier is positioned within the electrical connector such that the first end of the lever makes a first contact point with the edge contact when the carrier is actuated by an insertion of the printed circuit board or the like. The carrier continues a rotation motion as the printed circuit board or the like is further inserted, and the second end of the lever makes a second contact point with the pin. The second end of the lever causes the pin to be deflected as a result of the rotation motion of the carrier. The deflection causes a force to be transmitted through the first and second contact points, thereby to permit a piercing action to occur at the first and second contact points.

A specific embodiment of the electrical connector includes an electrically insulative housing which has two sidewalls, a front wall, a back wall, a top wall, and a base whose base centerline is along a surface of the base and parallel to the front and back walls, the surface of the base forming an inside surface of the electrically insulative housing. The top wall has an aperture centered in the top wall for receiving a printed circuit board or the like having a plurality of terminal strips. The electrically insulative housing has a cavity formed by the two sidewalls, the front wall, the back wall, the top wall and the base. A plurality of electrically conductive pins are arranged in two rows and are sufficiently flexible for providing a cantilever action. The two rows are along the base, parallel to and on opposite, equidistant sides of the base centerline. Each of the plurality of electrically conductive pins are affixed in and perpendicular to the base, spaced equally apart within the row, and extend through the base a sufficient length to permit external connections to be made to the plurality of electrically conductive pins. The pins further extend into the cavity a sufficient length to maintain an operative connection to the corresponding terminal strip of the printed circuit board or the like when the printed circuit board or the like is fully inserted into the electrical connector. Connecting carriers, are each positioned within the cavity for completing the operative connection between each of the plurality of electrically conductive pins to a corresponding one of the terminal strips of the printed circuit board or the like. The insertion of the printed circuit board or the like causes the connecting carriers to rotate thereby causing the connecting carriers to complete the operative connection.

From the foregoing it can be seen that it is a primary object of the present invention to provide an electrical connector having a low insertion force.

It is another object of the present invention to provide a low insertion force electrical connector using non-noble metals while providing good electrical contacts.

These and other objects of the present invention will become more apparent when taken in conjunction with the following description, and attached drawings, wherein like characters indicate like parts and which drawings form a part of the present application.

DETAILED DESCRIPTION

Figure 1:
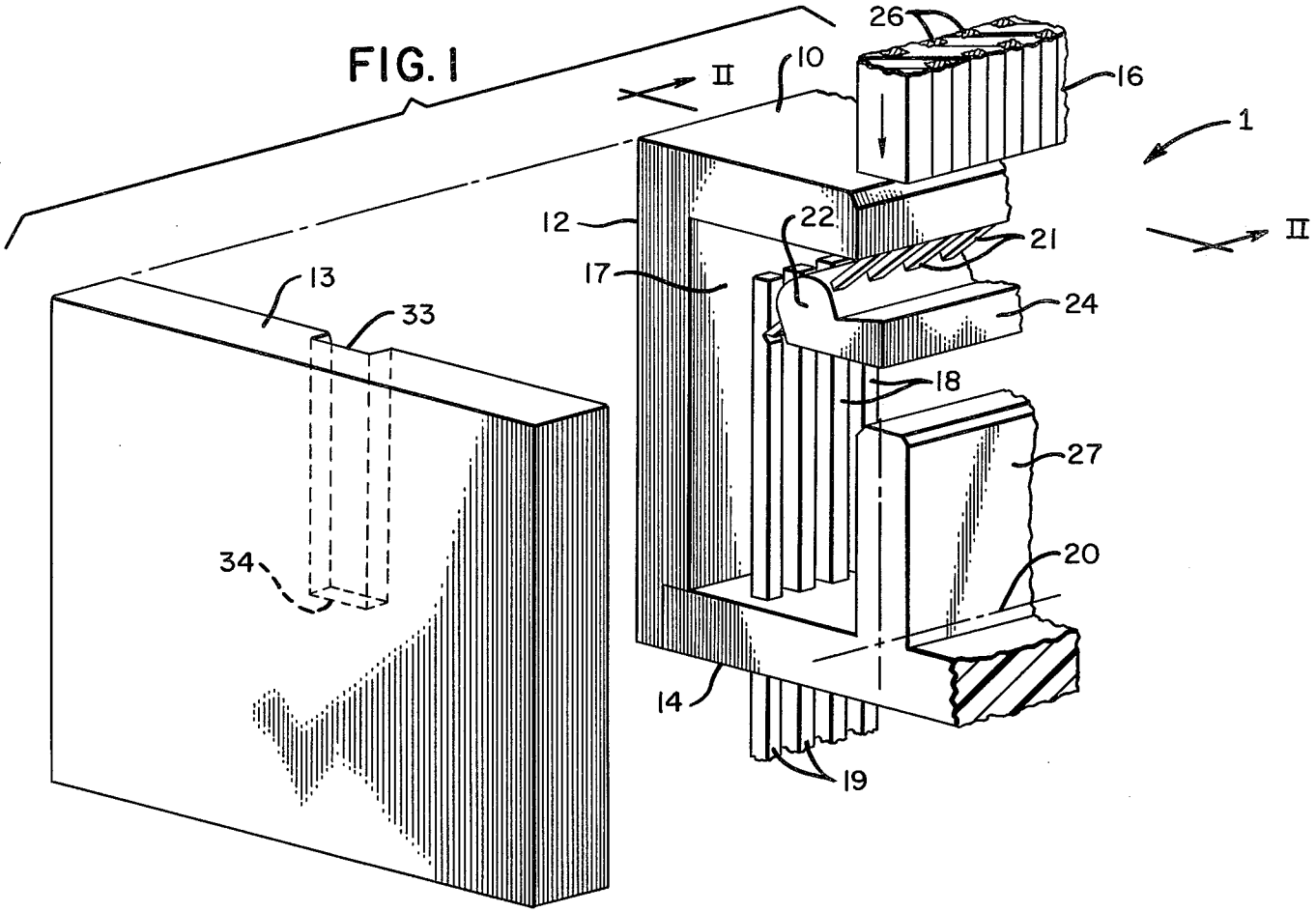
FIG. 1 is an exploded partial section view of the total connector assembly.
Figure 2A:
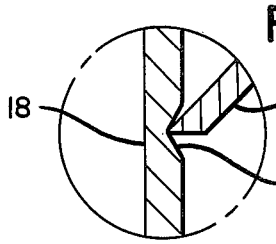
FIG. 2A is a magnified view of the encircled contact point of FIG. 2.
Figure 2:
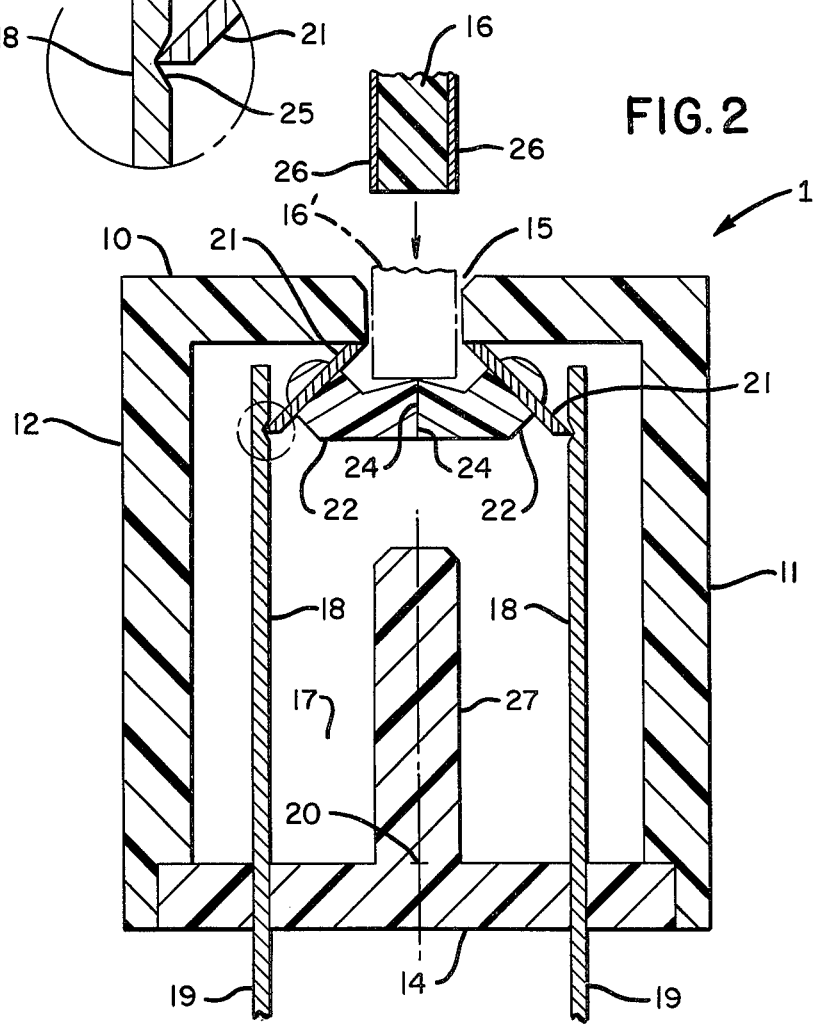
FIG. 2 is an end-view cross-section of the connector assembly of FIG. 1 taken along the section line II—II without the printed circuit board inserted.

The construction of the preferred embodiment connector 1 of the present invention is shown in FIGS. 1 and 2. FIG. 1 is a partial exploded section view of the total connector assembly and FIG. 2 is an end-view cross-section of the connector 1 without the printed circuit board or the like inserted. Referring to FIGS. 1 and 2, the connector housing, comprising a top wall 10, a front wall 11, a back wall 12, two side walls 13 (one is shown in FIG. 1) having a groove 33 for guiding the insertion of a printed circuit board, and a base 14, is shown which is made of an electrically insulative material. The walls and base of the connector housing form a hollow or cavity 17 within the connector 1. Top wall 10 has an opening 15 for permitting the insertion of a printed circuit board (PCB) 16 or the like into the connector 1, the PCB 16 having edge contacts or terminal strips 26.

In the preferred embodiment, two rows of pins 18 are permanently fixed in the base 14 which extends a length outside the connector housing 19 through the base 14 and into the cavity 17. The two rows are on opposite sides of a base centerline 20 and equidistant therefrom, the base centerline 20 being on the base surface and parallel to the front wall 11 and the back wall 12. The pins 18 are spaced apart equally within the row. It will be recognized by those skilled in the art that many alternative configurations may be devised within the true scope of the invention, including, a single pin, a single row of pins, or a row or rows of pins not spaced apart equally.

There is an electrically conductive lever 21 for each pin 18 providing the interconnection between the edge contact 26 and the pin 18, each lever 21 being partially encased in a lever carrier 22, or simply referred to herein as a carrier 22, made of an electrically insulative material, with both ends of the lever 21 extending outside the carrier 22 and both ends having a sharp point or edge. Each pin 18 extends far enough into the cavity 17 such that the corresponding lever 21 always maintains pin contact. Two carriers 22 are positioned within cavity 17, such that the levers can rotate in a plane substantially perpendicular to the base centerline 20. The pin 18 is capable of being deflected as a cantilever beam when a force is applied, the cantilever beam action to be described hereinunder. In the ready state, i.e. a condition in which the connector is ready for the PCB 16 or the like insertion, the two carriers 22 are held in position by the force exerted by the pins 18. The pins 18 in the ready state are slightly deflected causing the two carrier surfaces 24 to press against one another, thereby holding carriers 22 in equilibrium between the pins 18. The sharp edges of the levers 21 hold the levers 21 at a fixed point on the pins 18. As shown in FIG. 2A, a notch 25 can be placed in pin 18 to insure the lever 21/pin 18 position is maintained, the notch 25 being configured so as not to interfere with lever 21 rotation. The other end of the lever 21 is just outside opening 15 and may be in contact with the inside surface of top wall 10. The carrier 22 is so shaped that it doesn't interfere with the lever 21/pin 18 contact during any lever 21 rotation, the rotation of the lever 21 will be described in detail hereinunder. The carrier 22 is further shaped such that a portion of the carrier 22 extends in the path taken by the PCB 16 during insertion. The levers 21, pins 18, and edge contacts 26 may be made of an electrically conductive noble or non-noble metal. Again it will be recognized by those skilled in the art that, although the preferred embodiment shows the ends of the lever 21 having a chisel-like end configuration, the ends of the lever 21 may be configured to many different shapes while providing a good contact point with the pin 18 and the edge contact 26 respectively, the shapes including pointed, square edged, conical, and the like.

FIG. 2 shows the connector 1 in the ready state. The levers 21 are in the position as mentioned above such that the PCB 16 can travel beyond the edges of levers 21 to the point depicted by PCB 16' where initial contact is made with carriers 22, the carriers 22 being shaped such that a portion extends in the path of travel of PCB 16 as mentioned above.

Figure 3:
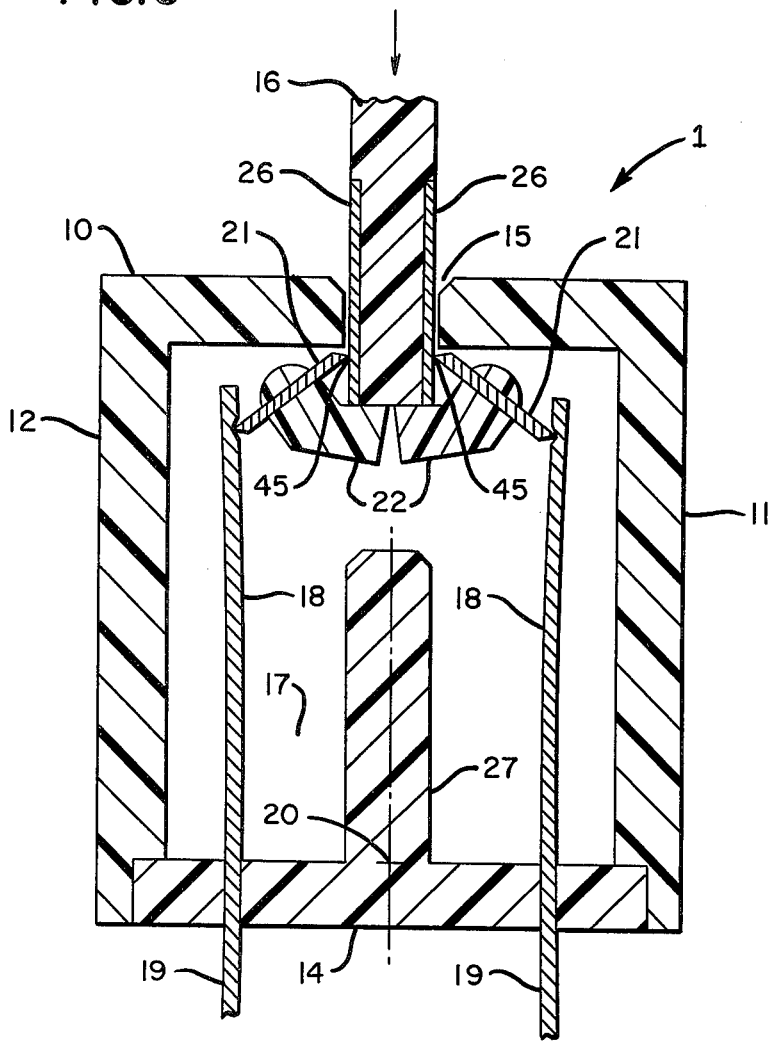
FIG. 3 is the end-view cross-section of the FIG. 2 connector with the printed circuit board partially inserted.

FIG. 3 shows the connector 1 in which the PCB 16 has traveled a sufficient distance to cause rotation of the carriers 22 such that the edges of the levers 21, which were shown initially resting upon the inner surface of top wall 10, are presently making contact at contact points 45 with their corresponding edge contacts 26 (or terminal strips) of PCB 16. Such rotation also causes a force against pins 18 by lever 21, thereby initiating a deflection of pins 18 from the initial or ready state. As PCB 16 is further inserted into connector 1, the leading edge of PCB 16 continues to push against carriers 22, and together with the contact point 45 made between levers 21 and edge contacts 26, the carriers 22 are rotated further, the initial contact points 45 being maintained throughout insertion of PCB 16 by the knife-like action of the sharp edges of levers 21.

Figure 4:
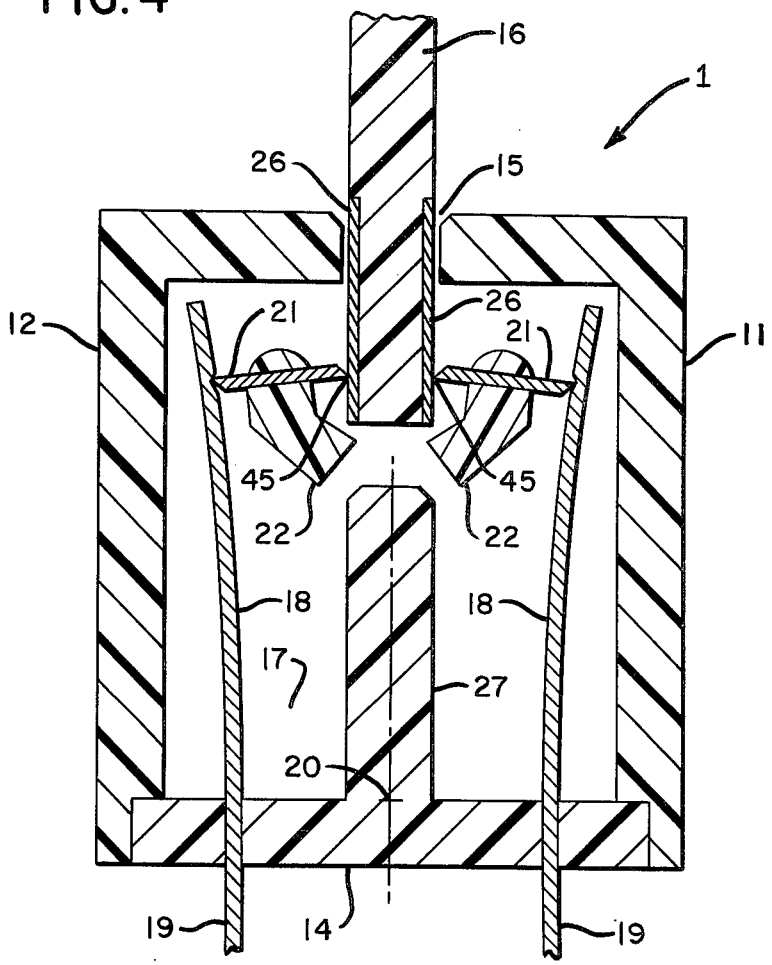
FIG. 4 is the end-view cross-section of the FIG. 2 connector with the printed circuit board inserted further than shown in FIG. 3.
Figure 5:
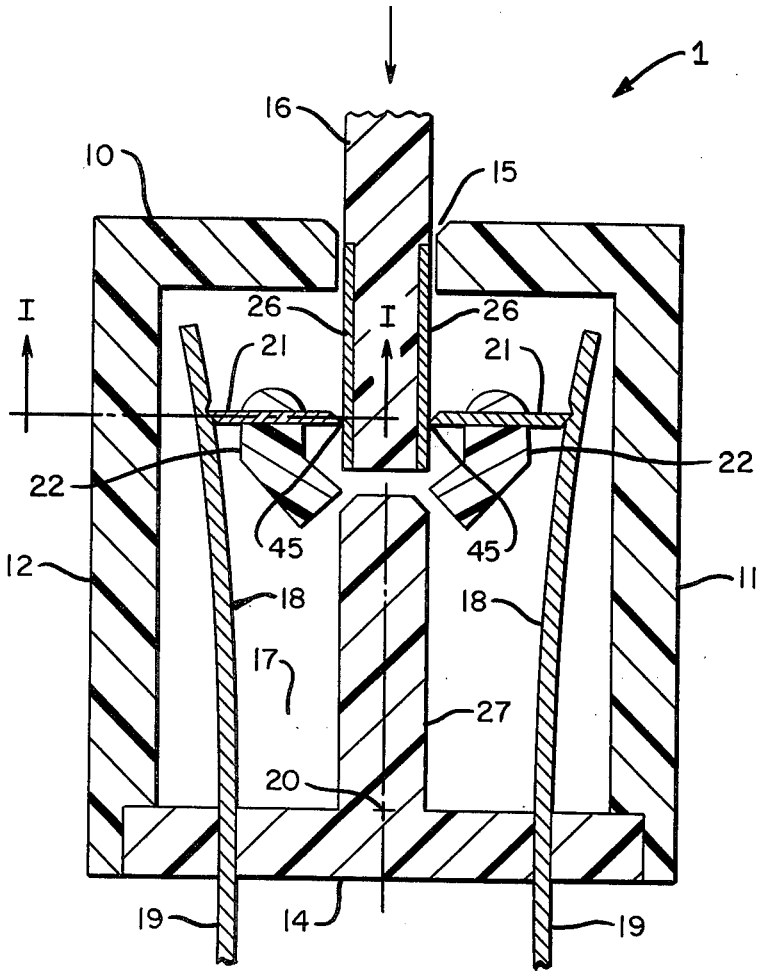
FIG. 5 is the end-view cross-section of the FIG. 2 connector with the printed circuit board inserted further than shown in FIG. 4.
Figure 6:
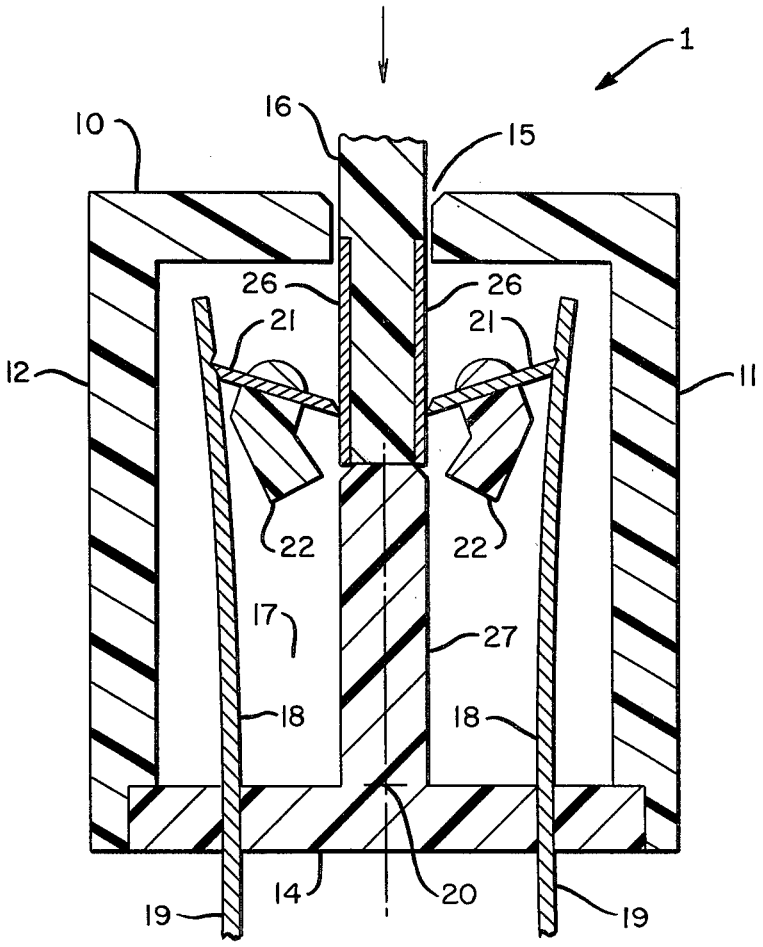
FIG. 6 is the end-view cross-section of the FIG. 2 connector with the printed circuit board fully inserted.

FIGS. 4 and 5 show interim positions of PCB travel during insertion and FIG. 6 shows the PCB 16 fully inserted, the PCB 16 travel being stopped by a block 27. It will be recognized by those skilled in the art that alternative means may be included for stopping the PCB 16 travel, including a step 34 in groove 33 (reference FIG. 1). FIG. 5 shows the levers 21 having rotated perpendicular to the PCB 16 causing the maximum deflection of pins 18. From a lever position beyond the perpendicular, there exists a small component of force along the PCB 16 travel path which results in a latching action of the PCB 16. The force required for insertion is that force required to overcome the small force component along the PCB travel path. It can be seen that the sharp points or edges at each end of the levers along with a high contact force caused by pin 18 deflection permits an action which pierces non-noble metallic oxides thus allowing good electrical connections. It will be understood by those skilled in the art that the piercing action of the non-noble metallic oxides includes actions such as friction, rubbing, knifing, cutting, etc., achieved by the lever 21 ends having alternative configurations mentioned above.

Figure 7A:
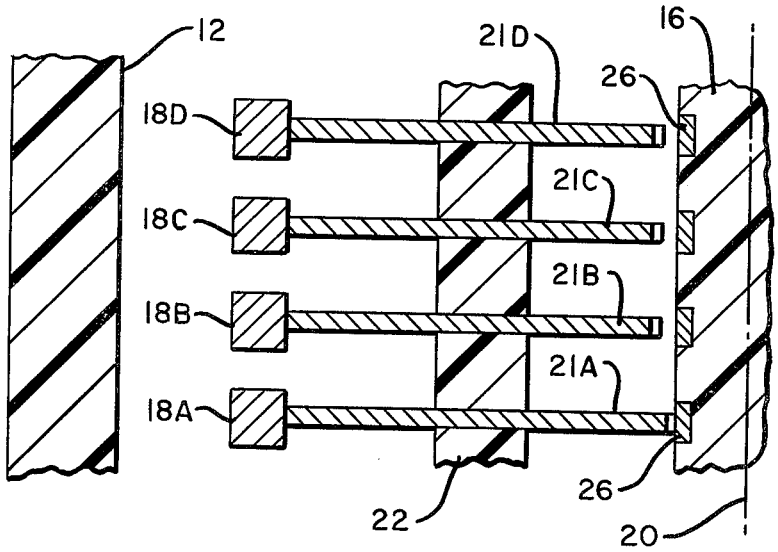
FIGS. 7A and 7B are a cross-sectional view of a partial connector taken along section line I—I of FIG. 5.
Figure 7B:
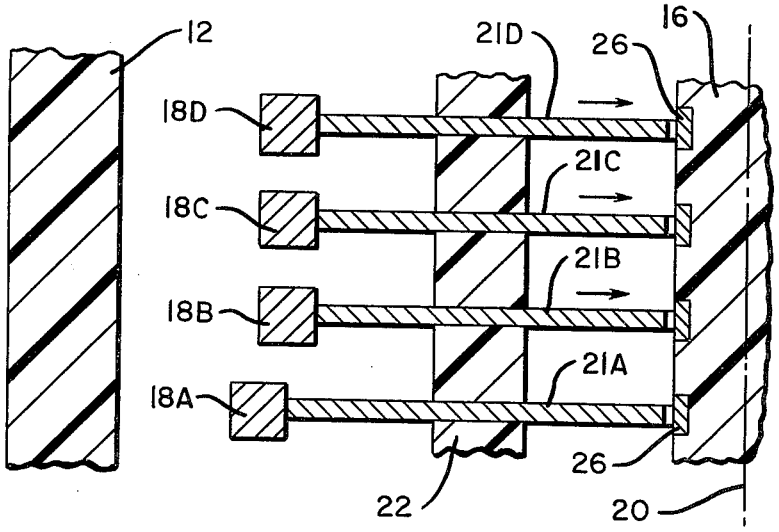

FIGS. 7A and 7B are a cross-sectional view of a partial connector 1 taken along section line I—I of FIG. 5. FIG. 7A shows levers 21A through 21D mounted in carrier 22 and by some error, shows lever 21A extending farther out of carrier 22 than levers 21B, 21C, and 21D on the side making contact with PCB 16. In such case, lever 21A has created a high-spot thereby preventing levers 21B, 21C, and 21D from making any contact with their corresponding edge contacts 26. Pins 18A through 18D press against their respective levers 21A through 21D, pin 18A being the only pin benefitting from the cantilever action. In an alternative embodiment, in order to correct for the error or to compensate for manufacturing tolerances, the levers 21 can be loosely fitted into the carrier 22, permitting the lever 21 to travel along its length, as indicated by the arrows of FIG. 7B, within the carrier 22. In this manner the lever 21 is responsive to the cantilever action of its respective pin 18 nullifying the effect of the high-spot.

Figure 8:
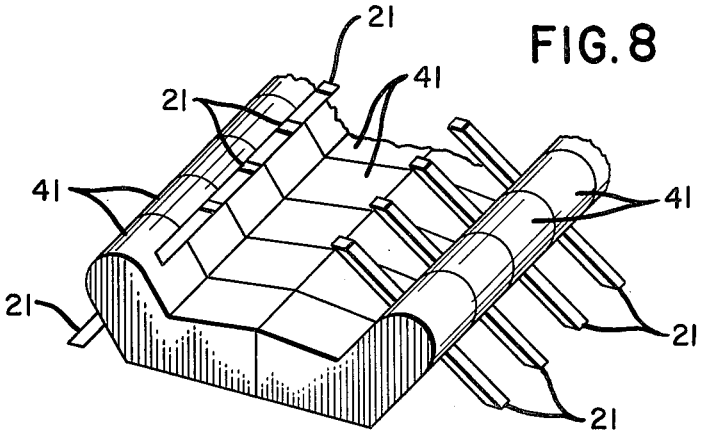
FIG. 8 shows an alternative embodiment of the carriers.

In yet another embodiment, each lever 21 is mounted in its own individual carrier 41, as shown in FIG. 8. In this embodiment, the lever 21 may be affixed within carrier 41 since the levers 21 will not be subject to a high-spot, each lever 21 being free to rotate independent of the other.

Figure 10:
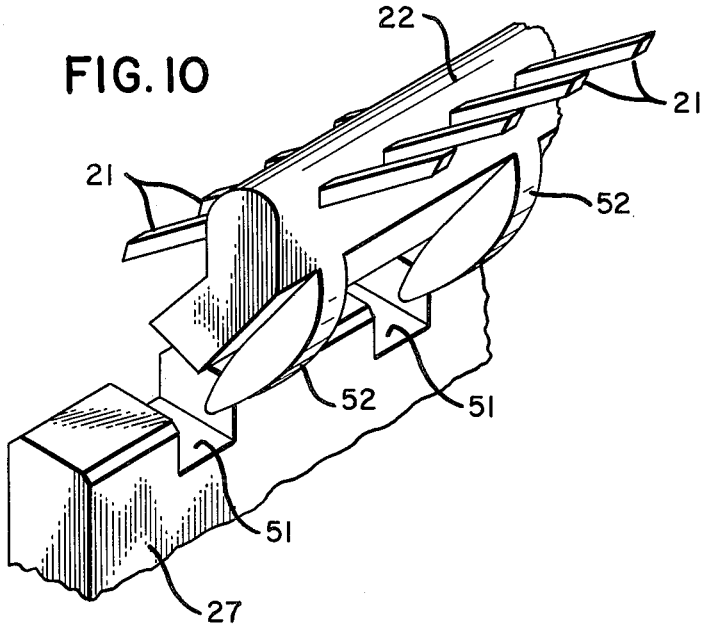
FIG. 10 is a perspective view of the alternative embodiment of the carriers of FIG. 9.
Figure 9:
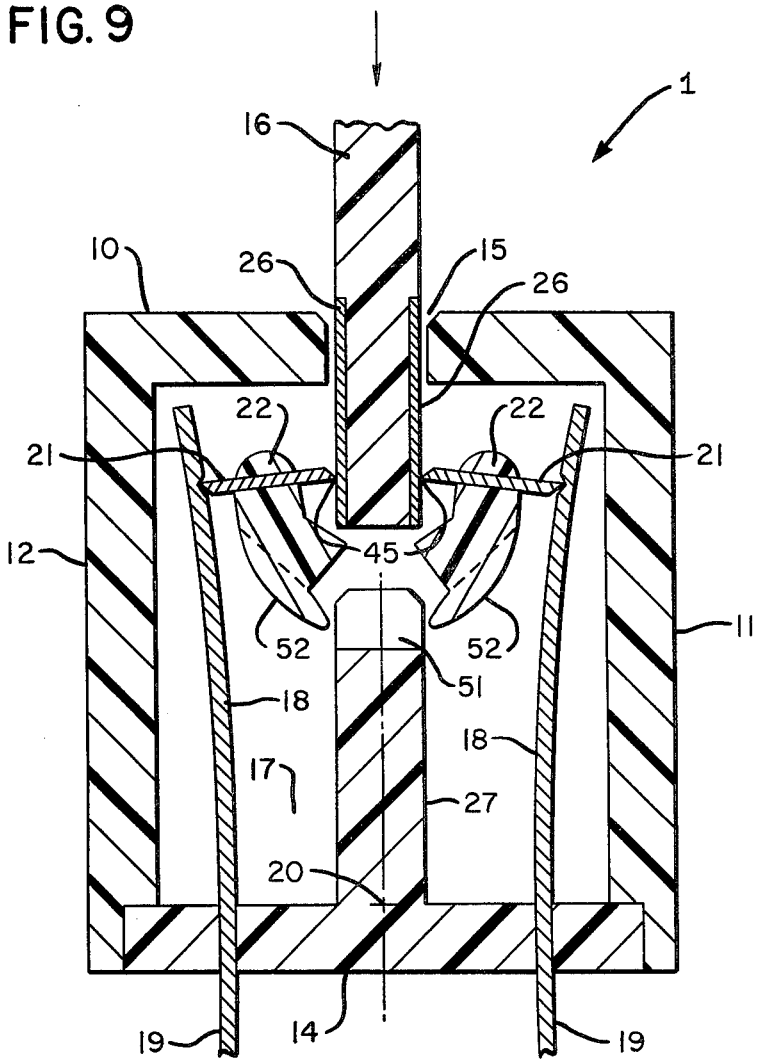
FIG. 9 is an end-view cross-section of the connector with another alternative embodiment of the carriers showing alignment fins.

FIGS. 9 and 10 show an alternative embodiment which includes fins 52 which is part of the carrier 22, the fins 52 being formed on the carrier 22 along the carrier length for every few pins. The fins 52 are configured complementary to each other such that the carriers 22 may close as shown in FIG. 2, and such that the carriers 22 may be fully opened as shown in FIG. 6 without interfering with pins 18. A slot 51 is made in block 27 to permit the carriers 22 to open unimpeded, the slot 51 placement corresponding to the placement of the fins 52. The fins 52 are utilized to assist in holding the alignment of the carriers 22 such that the axis of rotation of the carriers 22 remains parallel to the base centerline.

While there has been shown what is considered to be the preferred embodiment of the invention, it will be manifest that many changes and modifications can be made therein without departing from the essential spirit and scope of the invention. It is intended, therefore, in the annexed claims, to cover all such changes and modifications which fall within the true scope of the invention.

I claim:

1. An electrical connector for connecting to an edge contact of a printed circuit board or the like comprising:

(a) a pin made of an electrically conductive resilient material; and (b) interconnection means for operatively connecting said pin to said edge contact, said interconnection means positioned within said electrical connector and actuated by an insertion of the printed circuit board or the like, said interconnection means being configured to have two ends such that the first end of said interconnection means makes a first contact point with said edge contact when said interconnection means is actuated by the insertion of said printed circuit board or the like, said interconnection means continuing a rotation motion as said printed circuit board or the like is further inserted, and the second end of said interconnection means makes a second contact point with said pin, the second end of said interconnection means causing said pin to be deflected as a result of said rotation motion of said interconnection means, said deflection causing a force to be transmitted through said first and second contact points, thereby permitting a piercing action to occur at said first and second contact points.

2. An electrical connector for connecting to an edge contact of a printed circuit board or the like comprising:

(a) a pin made of an electrically conductive resilient material; and (b) interconnection means for operatively connecting said pin to said edge contact, said interconnection means positioned within said electrical connector and actuated by an insertion of the printed circuit board or the like, said interconnection means being configured to have two ends such that the first end of said interconnection means makes a first contact point with said edge contact when said interconnection means is actuated by the insertion of said printed circuit board or the like, said interconnection means continuing a rotation motion as said printed circuit board or the like is further inserted, and the second end of said interconnection means makes a second contact point with said pin, the second end of said interconnections means causing said pin to be deflected as a result of said rotation motion of said interconnection means, said deflection causing a force to be transmitted through said first and second contact points, thereby permitting a piercing action to occur at said first and second contact points, and the rotation reaching a point such that the force contains an inward component thereby providing a latching action for the printed circuit board or the like.

3. An electrical connector, according to claim 1 or 2 wherein said interconnection means comprises:

(a) a carrier made of an electrically insulative material, actuated by the insertion of the printed circuit board or the like; and (b) a lever made of an electrically conductive material, being partially encased within said carrier, having two ends for forming the first and second contact points with said edge contact and said pin, respectively.

4. An electrical connector, according to claim 3, which further comprises a block in the path of said insertion of said printed circuit board or the like, to prohibit further insertion of said printed circuit board or the like once a fully inserted position is attained.

5. An electrical connector according to claim 4, further comprising:

a housing.

6. An electrical connector according to claim 5, wherein said housing comprises:

(a) a base;

(b) a front wall mounted on said base;

(c) a back wall mounted on said base;

(d) two side walls mounted on said base, and together with said front wall and said back wall from an enclosure; and (e) a top wall, mounted on said enclosure thereby forming a cavity within said housing, said top wall having an aperture for receiving said printed circuit board or the like.

7. An electrical connector according to claim 6, further comprising:

(a) a plurality of said pins arranged in at least one row;

(b) at least one of said carriers positioned within said electrical connector, the number of carriers corresponding to the number of rows of said pins; and (c) a plurality of said levers, each lever mounted in a corresponding one of said carriers, each lever forming the operative connection with a corresponding one of the plurality of said pins.

8. An electrical connector comprising:

(A) an electrically insulative housing having two sidewalls, a front wall, a top wall, a back wall, and a base whose base centerline is along a surface of the base forming an inside surface of the electrically insulative housing, the top wall having an aperture centered in the top wall for receiving a printed circuit board or the like having a plurality of terminal strips, the electrically insulative housing further having a cavity formed by said two sidewalls, said front wall, said back wall, said top wall and said base;

(B) a plurality of electrically conductive pins arranged in two rows and being sufficiently flexible for providing a cantilever action, the two rows being along the base, parallel to and on opposite, equidistant sides of the base centerline, each of said plurality of electrically conductive pins being affixed in and perpendicular to the base and being spaced equally apart within the row, and extending through the base a sufficient length to permit external connections to be made to said plurality of electrically conductive pins, and further extending into the cavity a sufficient length to maintain an operative connection to the corresponding terminal strip of said printed circuit board or the like when said printed circuit board or the like is fully inserted into said electrical connector;

(C) a pair of connecting means, each positioned within said cavity for completing the operative connection between each of said plurality of electrically conductive pins to a corresponding one of said terminal strips of said printed circuit board or the like, the insertion of said printed circuit board or the like causing said connecting means to rotate thereby causing the connecting means to complete said operative connection, each one of said connecting means comprises:

(a) a carrier of an electrically insulative material, said carrier being configured such that any carrier motion or rotation will not interfere with said operative connection during and after the insertion of the printed circuit board or the like and being further configured such that the carrier extends into the path of travel of said printed circuit board or the like during the initial part of the insertion; and (b) a plurality of levers of an electrically conductive material, each lever being held in said carrier such that both ends of the levers are external to the carrier, and further held in said carrier such that said levers rotate in a plane substantially perpendicular to said base centerline, both ends of said levers having points or edges.

9. An electrical connector according to claim 8, wherein each lever is loosely held in said carrier thereby permitting said lever to move in a lengthwise direction within said carrier.

10. An electrical connector according to claim 9 wherein each sidewall of said electrically insulative housing further has a partial groove along a partial length of the inner surface starting from an edge abutting the top wall and continuing toward the base to a distance required by the printed circuit board or the like to travel for full insertion, the partial groove reaching an end-point, said end-point impeding any further movement after full insertion has been achieved, said partial groove being perpendicular to said base.

11. An electrical connector according to claim 9, wherein said carriers further includes alignment means.

12. An electrical connector according to claim 11 wherein said alignment means comprises:

at least one fin attached to each carrier in a complementary manner such that the fins mesh together without interfering with the operative connection or the rotation of said carrier, the fins being in a plane perpendicular to said base centerline.

13. An electrical connector according to claim 12, wherein said connector further comprises:

an inner wall mounted in the cavity of said connector, on said base and along said base centerline, being of a height sufficient to impede further insertion of said printed circuit board or the like after full insertion has occurred.

14. An electrical connector according to claim 13, wherein said sidewall of said electrically insulative housing further has a groove along the full length of the inner surface perpendicular to said base for guiding the insertion of the printed circuit board or the like.

* * * * *